United States Patent [19]

Baker et al.

[11] 4,352,007

[45] Sep. 28, 1982

[54] HOT MELT MULTI-SECTION HOSE HEATING SYSTEM

[75] Inventors: Robert G. Baker, Buford; Dario J. Ramazzotti, Atlanta, both of Ga.

[73] Assignee: Nordson Corporation, Amherst, Ohio

[21] Appl. No.: 199,488

[22] Filed: Oct. 22, 1980

[51] Int. Cl.[3] ..... H05B 3/58

[52] U.S. Cl. ..... 219/301; 219/522; 219/535; 219/549; 338/208

[58] Field of Search ..... 219/545, 522, 549, 301, 219/535; 338/208; 174/109; 222/146 R, 146 HE; 138/33; 137/341

[56] References Cited

U.S. PATENT DOCUMENTS

| | | | |
|---|---|---|---|
| 787,047 | 4/1905 | Leonard | 338/266 |
| 1,525,838 | 2/1925 | Waller | 338/208 |
| 2,412,843 | 12/1946 | Spraragen | 219/545 |
| 2,578,280 | 12/1951 | Barnard | 174/95 |
| 2,758,194 | 8/1956 | Heron | 219/552 |
| 2,793,280 | 5/1957 | Harvey | 219/549 |
| 2,801,323 | 7/1957 | Heron | 219/522 |
| 2,824,209 | 2/1958 | Leipold | 219/528 |
| 2,938,992 | 5/1960 | Crump | 219/528 |
| 3,378,673 | 4/1968 | Hopper | 219/301 |
| 3,727,029 | 4/1973 | Chrow | 219/301 |
| 3,789,188 | 1/1974 | Rudbarg | 219/301 |
| 4,038,519 | 7/1977 | Foucras | 219/301 |

*Primary Examiner*—Bernard Roskoski
*Attorney, Agent, or Firm*—Wood, Herron & Evans

[57] ABSTRACT

A heating system is disclosed for a hot melt hose having multiple physically and thermally interchangeable series-connected heated hose sections wherein different hose sections exhibit different electrical power requirements per unit length. The multiple sections of the hose are physically and electrically interconnected end-to-end between a pressurized hot melt source and a hot melt dispenser, such as a hand-held gun, having a trigger-controlled valve for regulating the flow of hot melt from the gun. Each of the hose sections includes an inner, fluid impervious, chemically inert tube, preferably fabricated of tetrafluoroethylene; an electrically conductive multi-strand braided sheath snugly embracing the exterior surface of the inner tube and in intimate heat transfer contact therewith for supplying strength and heat to the tube; and an outer sheath of thermal insulating material surrounding the intermediate braided sheath for minimizing heat loss to the environment. At least two of the hose sections have outer thermal insulating layers exhibiting different heat loss per unit length and associated electrically conductive braided sheaths of substantially equal strength and flexibility, but exhibiting different electrical power consumption per unit length. As such, when the braided sheaths of different hose construction are series-connected and a constant current from a regulated constant current power source is passed through the serially-connected braided sheaths, the temperature of the hot melt material within the different hose sections is maintained at substantially the same temperature notwithstanding the difference in the heat loss characteristics of the thermal insulating outer layers of the different hoses.

5 Claims, 2 Drawing Figures

HOT MELT MULTI-SECTION HOSE HEATING SYSTEM

Figure 1:
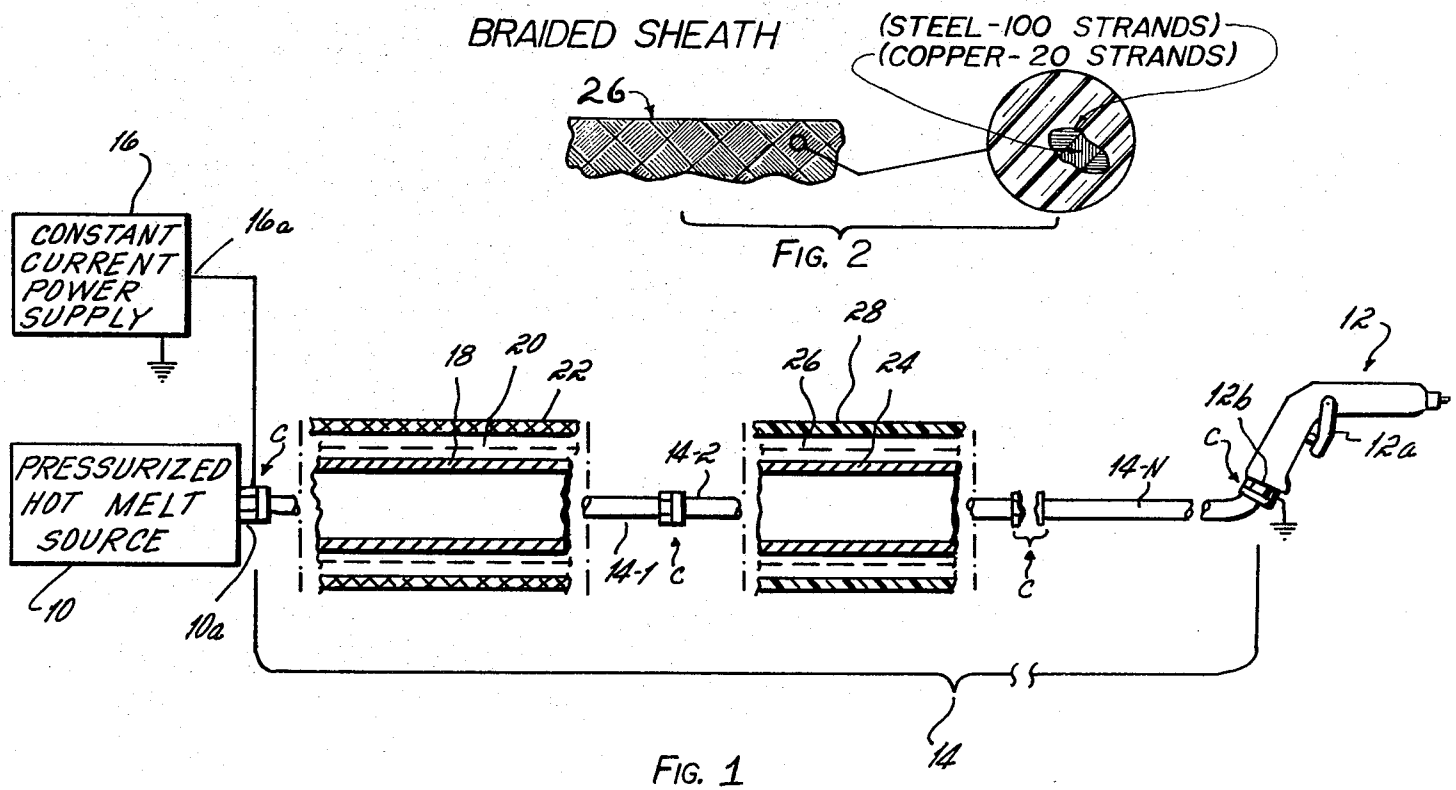

This invention relates to a hot melt multi-section hose heating system, and more particularly to a heating system for a hot melt hose having multiple physically and thermally interchangeable series-connected sections in which different hose sections have different electrical power requirements per unit length.

Hot melt dispensing systems of the type with respect to which this invention possesses a particularly high degree of utility typically include a source, or tank, of molten adhesive. The adhesive is maintained at a desired temperature in the tank, such as 350° F., by a suitable thermostatically controlled tank heater. The molten adhesive is supplied under pressure by a pump to a dispenser via a hose. The dispenser may be a hand-held gun having a trigger-controlled valve for regulating the flow of hot melt adhesive from the gun. To avoid undesirable temperature drop in the hot melt adhesive between the time it is pumped from the tank and the time it is dispensed from the gun, the hose interconnecting the pressurized source of hot melt material and the dispenser is usually heated.

As would be expected, the required length of hose between the pressurized source and the dispenser varies from one application to another. While it is possible to accommodate these different length hose requirements by connecting single hoses of different length between the tank and gun, it has been found more convenient to provide hose sections of some arbitrary, but fixed, length such as ten feet. Depending upon the length of hose required for a particular application, different numbers of these fixed-length hoses can be serially connected end-to-end to provide a multi-section hose of the desired length.

A typical heated not melt hose includes an inner tube through which the hot melt adhesive actually flows. This inner tube, which is in contact with the adhesive, is fluid impervious and chemically inert relative to the hot melt material. The inner tube additionally possesses certain other desirable characteristics such as strength, flexibility, electrical nonconductivity, and the like. A suitable material for the inner tube, exhibiting the foregoing characteristics, has been found to be tetrafluoroethylene. The hot melt hose also typically includes a single layer of stainless steel wire braid which surrounds the inner tube. The wire braid performs the dual function of providing structural reinforcement for the tube as well as serving as an electrical resistance heater for the tube along its length. For these reasons the single layer stainless steel wire braid reinforcement snugly embraces the outer surface of the inner tube as well as is in intimate thermal contact therewith. Surrounding the metal braid is a sheath of electrically nonconductive thermal insulating material for minimizing heat loss to the environment.

In the past the sections of hose used in a given installation have been identically constructed, particularly with respect to the thermal insulating properties of the outer sheath. As a consequence, to maintain the temperature of the material in each hose section of an installation at a predetermined arbitrary value, e.g., 350° F., the electrical power requirements per unit length for the various series-connected hose sections have been substantially identical. For example, where the thermally insulating outer sheath of a hose section was asbestos, it was necessary to provide approximately 48.6 watts of electrical power per foot of hose to maintain the adhesive in the hose at approximately 350° F. when supplied from a tank maintained at the same temperature. The required electrical power was provided by electrically connecting in series circuit relationship the intermediate conductive braid layers of the various series-connected hose sections and passing therethrough a constant current from a regulated constant current power source. For example, in one particular application designed to maintain the temperature of asbestos-insulated hoses at 350° F., 28 amperes from a constant current source is passed through the braided sheaths of the series-connected hoses. With each braided sheath consisting of 120 strands of 0.009 inch diameter 303 stainless steel wire wound with a wire pitch of approximately one inch, to provide approximately 18.5 inches of wire per strand per foot of hose length, an equivalent resistance per foot of hose of 0.062 ohms results. Such a hose, when input with 28 amperes of current, consumes a total power of 48.6 watts per foot of hose.

For various reasons it has been found desirable to substitute a different material, such as silicone rubber sponge, for the thermally insulating asbestos outer layer found in existing hoses. Due to reduced thermal conduction and convection characteristics of this substitute thermal insulating hose material, the heat loss per unit length of hose is materially reduced in contrast to similar hoses provided with an asbestos thermal insulating outer layer. By reason of the fact that the outer thermal insulating layer has reduced heat loss properties, the electrical power requirement per foot of hose is also reduced. While this is obviously desirable from an energy-consumption standpoint, it presents a problem where multi-section hoses are assembled indiscriminately from sections of both asbestos-clad hose and hoses clad with the improved silicone insulating material. The problem arises by virtue of the fact that the braided sheaths of the series-connected hose sections having different types of thermal insulation are energized from a constant current source. As a consequence, while a 28-ampere current is necessary to provide a 350° F. hose temperature for a hose of the asbestos-clad type, passage of a current of the same magnitude through a hose clad with a silicone rubber sponge insulation having a significantly lower heat loss per foot of hose length results in a hose temperature for the silicone rubber sponge insulated hose which far exceeds the 350° F. desired.

Various solutions to the foregoing problem have been proposed. For example, a shunt resistor was connected in electrical parallel circuit relation with the braided sheath of the hose clad with the improved insulation. The resistance value of the shunt resistor was selected to provide a current flow through the braid of a reduced level consistent with the enhanced thermal insulating properties of the improved insulation, thereby maintaining the hose temperature at the desired 350° F. temperature level. The problem with this approach is that if the shunt resistor and/or its electrical connection becomes defective such that it no longer shunts the braid of the improved hose, the full value of current passes through the braid, providing temperatures in the hose which far exceed the desired value.

Another approach to accommodating series-connected hoses having different heat losses per unit length, which are connected end-to-end with their braided electrical heating elements in series electrical circuit relationship to a constant current source, is to increase the number of strands of the braid of the hose having the improved insulation while keeping the strand diameter the same, or alternatively, increase the diameter of each strand while maintaining the number of strands constant. Unfortunately, both of these approaches produce a braid which is significantly stiffer than previously existed. A stiffer hose is undesirable from a user standpoint, particularly when using a hand-held hot melt dispenser, because it increases operator fatigue. It is undesirable for a further reason, namely, the increased expense of the braided sheath occasioned by the increase in number and/or diameter of the braid strands.

Accordingly, it has been an objective of this invention to provide a hose having reduced heat loss per unit length, which can be series-connected with hoses of higher unit length heat loss and which, when energized from a common constant current source, is maintained at a hose temperature substantially identical to that of the higher heat loss hose, and yet exhibits substantially the same flexibility, strength, and cost as the higher heat loss hose. This objective has been accomplished in accordance with certain of the principles of this invention by providing the hose of low heat loss with a braided sheath which, while having the same number of strands of wire of the same diameter as the higher heat loss hose, has some of the strands constructed of low resistance material, such as copper, and the remaining strands constructed of higher resistance material, such as stainless steel, of the type used in all the strands of the braided sheath of the higher heat loss hose.

With the foregoing arrangement, since neither the number of strands nor the diameter of the strands in the braid of the lower heat loss hose has changed, the strength, flexibility, and cost of the braid of the thermally improved hose is substantially unchanged. Yet, the resistance per unit length of the improved hose is reduced commensurate with the reduction in heat loss from the outer thermal insulating layer of the improved hose, with the result that the temperature in the improved hose is maintained at substantially the same level as in the higher heat loss hose notwithstanding that a constant current of the same magnitude passes serially through both the higher heat loss hose and the lower heat loss hose. As a consequence, with this invention hoses of different heat loss characteristics can be physically interchanged at random in multi-section, serially connected, hose configurations and serially energized from a constant current power supply and the temperatures of the various hose sections of different construction maintained at the same desired level.

These and other features, advantages, and objectives of the invention will become more readily apparent from a detailed description of the invention taken in conjunction with the drawings in which FIG. 1 is a schematic diagram of a hot melt multi-section hose heating system incorporating hose sections which are physically and thermally interchangeable and yet have different electrical power requirements per unit length.

FIG. 2 is a top plan view of a portion of a composite strand copper and steel braided sheath.

With reference to FIG. 1, the system of this invention is seen to include a pressurized source 10 of hot melt adhesive which is equipped with a suitable thermostatically controlled heater (not shown) for maintaining molten adhesive at a desired temperature, such as 350° F. Of course, by suitable adjustment of the heater the temperature of the molten adhesive in the tank 10 can be adjusted to any desired temperature compatible with the particular chemical composition of the adhesive.

Also included in the system is a molten adhesive dispenser 12. The dispenser 12 can be of the hand-held variety, such as a gun, having a manually operated trigger 12*a* which controlls a flow valve (not shown) in the gun for selectively regulating the flow of pressurized molten adhesive from the gun dispenser. Alternatively, the dispenser 12 may be of the type typically found in an automatic installation in which the dispenser is either stationarily mounted, such as in operative relation to a conveyor line on which articles move therepast for receiving shots of molten adhesive, or alternatively, movably mounted on a suitable motorized reciprocator under automatic control for applying molten adhesive to an article in a predetermined pattern.

Interconnecting the dispenser 12 and the tank 10 is a multi-section hose 14 consisting of individual sections 14-1, 14-2, . . . 14-n. The hose sections 14-1, 14-2, . . . 14-n are provided with suitable coupling elements C at their respective ends to facilitate serial interconnection between an outlet 10*a* of the tank 10 and an inlet 12*b* of the dispenser 12. The couplings may be of any suitable type such as conventional threaded fittings, quick disconnect fittings, etc. At least two of the hose sections of the multi-section hose 14 have different electrical power requirements per unit length to maintain the respective hose sections at the same preselected arbitrary temperature, e.g., 350° F. The heating elements of the hose sections 14-1, 14-2, . . . 14-n of the hose assembly 14 are connected in electrical series relationship with the output 16*a* of a regulated constant current power supply 16. The power supply 16 is provided with a suitable control (not shown) which facilitates selectively varying the amperage output therefrom on line 16*a* to the heaters of the hose assembly 14 to, in turn, facilitate selectively varying the temperature at which the hose sections 14-1, 14-2, . . . 14-n of the hose assembly 14 are commonly maintained.

In accordance with the preferred embodiment of the invention, at least one of the hose sections, such as section 14-1, includes an inner tube 18 which is chemically inert and fluid impervious relative to the hot melt material passing therethrough from the pressurized hot melt tank 10 to the dispenser 12. A suitable inner tube 18 can be fabricated of tetrafluoroethylene resin extruded to form a smooth seamless tube having an inner tube diameter of approximately 0.313 inches with a wall thickness of 0.040 inches. Surrounding the inner tube 18 is a braided sheath 20 of electrically conductive resistance heating material. In a preferred form, the sheath 20 consists of 120 strands of braided wire having a one inch pitch. By reason of the pitch and braid diameter, the strands are 18.49 inches per foot of braid. The wire strands are fabricated of 0.009 inch diameter 303 stainless steel, providing a resistance per strand per foot of braid of 7.44 ohms. With a braided sheath of the type described, the total resistance of the sheath per foot is 0.062 ohms. When input with a constant current of 28 amperes, a power consumption of 48.6 watts per foot results.

The braided sheath 20 provides the dual function of supplying heat to the tube 18 for maintaining the temperature therein at some preset desired value, such as 350° F., as well as providing the tube 18 with added structural strength against bursting. To maximize the strength and heat transfer provided to the inner tube 18 by the braided sheath 20, the braided sheath snuggly embraces the outer surface of the tube 18 with respect to which it is in intimate thermal contact.

Surrounding the braided electrically conducting sheath 20 is a sheath 22 of thermal insulating material, such as asbestos, having a wall thickness of 0.250 inches. With a thermally insulating outer sheath 22 provided around the conductive resistance heating braided sheath 20 having the composition and construction of the type described, when the sheath 20 is energized with a current of 28 amperes from the constant current supply 16, the hose section 14-1 consumes 48.6 watts per foot to maintain the temperature within the hose section at approximately 350° F.

As indicated, the hose section 14-2 has a different electrical power requirement per foot, by reason of its construction, to maintain the temperature of the hose section at the same temperature as the hose section 14-1, namely, 350°. In a preferred form of the invention the hose section 14-2 includes an inner tube 24 which has a construction substantially identical to that of the tube 18 of the hose section 14-1. Also included in hose section 14-2 is an electrically conductive braided sheath 26 having substantially the same number of strands as the braided sheath 20, which strands in the sheath 26 have a diameter substantially identical to the strands in the sheath 20. However, in a manner to be described shortly hereafter, the composition of the strands of the braided sheath 26 is not identical to that of the braided sheath 20. The braided sheath 26, like the braided sheath 20, snugly embraces the outer surface of the inner tube 24 to provide structural reinforcement thereto and is in intimate thermal contact therewith to facilitate maximum heat transfer between the braided sheath 26 and the tube 24.

Also included in the hose section 14-2 is an outer sheath 28 which surrounds the braided sheath 26. The outer sheath 28, in a preferred embodiment of the invention, is fabricated of silicone rubber sponge plastic material having a thickness of 0.500 inches. If desired the thermal insulation sheath 28 can be provided with a polyester web outer jacket to enhance the abrasion resistance of the hose assembly 14-2.

Due to the relatively lower conduction and convection heat loss characteristics of the thermally insulating sleeve 28 of hose section 14-1 in comparison to the thermally insulating sleeve 22 of hose section 14-2, only 17 watts per foot are required for hose section 14-2 to maintain the temperature of hose section 14-2 at the same level as the hose section 14-1, for example, at 350° F., when the same constant magnitude of electrical current, such as 28 amperes, is passed serially therethrough.

To facilitate providing reduced power consumption for the hose section 14-2 consistent with the improved thermal insulating properties of the outer sheath 28, when the same current is passed through braided sheath 26 as is passed through braided sheath 20 surrounded by an insulating layer 22 of greater heat loss properties, and yet provide a sheath 26 which has the same strength and flexibility as the sheath 20, a fraction of the total number of strands of the braided sheath 26 are fabricated of conventional low resistance electrical copper wire while the remaining strands are fabricated of conventional higher resistance 303 stainless steel. For example, in a preferred embodiment of the invention depicted in FIG. 2, of the 120 strands wound at one inch pitch in the braided sheath 26 of the hose sections 14-2 having the improved outer thermal insulating sheath 28, twenty of the 120 strands of the braided sheath 26 are fabricated of copper, with each copper strand exhibiting a resistance of 0.584 ohms per foot of hose. With twenty such copper strands, a resultant resistance for the twenty copper strands is 0.0292 ohms per foot. The remaining 100 strands of 303 stainless steel, each strand of which exhibits a resistance per foot of 7.44 ohms, provides an equivalent resistance for the 100 strands of 0.0744 ohms per foot. The net resistance of the composite braided sheath 26, including twenty copper strands and 100 stainless steel strands, is 0.021 ohms per foot. When a constant current of 28 amperes is passed through the conductive braided sheath 26, 17 watts per foot are consumed, maintaining the temperature in the hose at approximately 350° F. Whereas, and by way of contrast, when the same current of 28 amperes is passed through the conductive sheath 20 of hose section 14-1 having the greater loss thermal insulating sheath 22, 48.6 watts per foot are consumed to maintain the temperature of that hose section at the same temperature as hose section 14-2, namely, 350° F.

The inner tubes 18 and 24 and the outer sheaths 22 and 28 are fabricated of electrically nonconductive material to prevent electrical short-circuiting or shunting of the intermediate electrically conductive braided sheaths 20 and 26, respectively.

While the preferred embodiment of the invention has been described with reference to two different hose constructions having specific materials, dimensions, and the like for the various constituent elements, this has been done for the purpose of illustration only. It will be apparent to those skilled in the art that as the relative thermal insulating properties of the different hoses are varied with respect to each other, the proportion of low resistance strands and high resistance strands of the braided sheath 26 of the lower heat loss hose can be varied to provide a temperature therein substantially identical to that of the higher heat loss hose when a current of constant magnitude is identically passed through the conductive sheaths of the serially-connected high heat loss and the low heat loss hose sections.

Additionally, and as those skilled in the art will understand, any suitable means may be used to electrically serially interconnect the braided sheaths of the different hose sections 14-1, 14-2, . . . 14-n. Preferably such electrical connection is effected via the hose section couplings C which may be fabricated of electrically conductive material and include an integral collar which is crimped around and in physical and electrical contact with the end of the conductive braid sheath with which it is associated.

What is claimed is:

1. A heating system for a hot melt hose interconnecting a source of pressurized hot melt adhesive and a dispenser, comprising:

a first hot melt hose section having:

(a) a first inner electrically nonconductive tube which is chemically inert and fluid impervious relative to hot melt adhesive which flows under pressure therethrough, (b) a first outer electrically nonconductive sheath of thermally insulating material surrounding said first inner tube and exhibiting a specified heat loss per unit length of hose, and (c) a first intermediate electrically conductive braided sheath between said first inner tube and first outer sheath for strengthening said first hot melt hose and providing heat thereto when supplied with an electrical current of preset magnitude to maintain the temperature within said first inner tube at a predetermined value, said first braided sheath having N strands of relatively high resistance wire of diameter d;

a second hot melt hose section having:

(a) a second inner electrically nonconductive tube which is chemically inert and fluid impervious relative to hot melt adhesive which flows under pressure therethrough, (b) a second outer electrically nonconductive sheath of thermally insulating material surrounding said second inner tube and exhibiting substantially less heat loss per unit length of hose than said specified heat loss of said first outer sheath, (c) a second intermediate electrically conductive braided sheath between said second inner tube and said second outer sheath for strengthening said second hot melt hose and providing heat thereto when supplied with an electrical current of said preset magnitude to maintain the temperature within said second inner tube at said predetermined value notwithstanding said substantially less heat loss of said second outer sheath, said second braided sheath having N-M strands of relatively high resistance wire of diameter d and M strands of relatively low resistance wire of diameter d, said N-M strands and said M strands of said second braided sheath collectively dissipating, when input with electrical current of said preset magnitude, substantially less electrical power per unit length of hose than said N strands of said first braided sheath consistent with the substantially improved heat loss characteristics of said second outer thermally insulating sheath relative to said first outer thermally insulating sheath, said first and second braided sheaths having substantially the same flexibility and strength;

means for interconnecting said first and second hot melt hose sections in series between said hot melt source and said dispenser with said first and second inner tubes communicating for hot melt flow therethrough and with said first and second braided sheaths in electrical series for passage therethrough of a common electrical current; and an electrical power supply across which said first and second braided sheaths are connected in electrical series for passage therethrough of said common electrical current.

2. The system of claim 1 wherein said N strands of said first braided sheath and said N-M strands of said second braided sheath are fabricated of steel, and said M strands of said second braided sheath are fabricated of copper.

3. The system of claim 2 wherein said first outer sheath is asbestos and said second outer sheath is a plastic composition.

4. The system of claim 3 wherein said plastic composition is silicone rubber sponge material, and wherein N=120 and M=20.

5. In a hot melt system having a pressurized source of hot melt material, a remotely located hot melt dispenser, and a constant current electrical power supply, an improved hose assembly comprising:

a first hot melt hose section having:

(a) a first inner electrically nonconductive tube which is chemically inert and fluid impervious relative to hot melt adhesive which flows under pressure therethrough, (b) a first outer electrically nonconductive sheath of thermally insulating material surrounding said first inner tube and exhibiting a specified heat loss per unit length of hose, and (c) a first intermediate electrically conductive braided sheath between said first inner tube and first outer sheath for strengthening said first hot melt hose and providing heat thereto when supplied with an electrical current of preset magnitude to maintain the temperature within said first inner tube at a predetermined value, said first braided sheath having N strands of relatively high resistance wire of diameter d;

a second hot melt hose section having:

(a) a second inner electrically nonconductive tube which is chemically inert and fluid impervious relative to hot melt adhesive which flows under pressure therethrough, (b) a second outer electrically nonconductive sheath of thermally insulating material surrounding said second inner tube and exhibiting substantially less heat loss per unit length of hose than said specified heat loss of said first outer sheath, (c) a second intermediate electrically conductive braided sheath between said second inner tube and said second outer sheath for strengthening said second hot melt hose and providing heat thereto when supplied with an electrical current of said preset magnitude to maintain the temperature within said second inner tube at said predetermined value notwithstanding said substantially less heat loss of said second outer sheath, said second braided sheath having N-M strands of relatively high resistance wire of diameter d and M strands of relatively low resistance wire of diameter d, said N-M strands and said M strands of said second braided sheath collectively dissipating, when input with electrical current of said preset magnitude, substantially less electrical power per unit length of hose than said N strands of said first braided sheath consistent with the substantially improved heat loss characteristics of said second outer thermally insulating sheath relative to said first outer thermally insulating sheath, said first and second braided sheaths having substantially the same flexibility and strength;

means for interconnecting said first and second hot melt hose sections in series between a hot melt source and dispenser with said first and second inner tubes communicating for hot melt flow therethrough, and said first and second braided sheaths in electrical series for passage therethrough of a common electrical current; and means for connecting said first and second braided sheaths in series across a constant current power supply for passage through said serially-connected first and second braided sheaths a common electrical current.

* * * * *